United States Patent [19]

Meday

[11] 4,286,323

[45] Aug. 25, 1981

[54] ELECTRONIC SCORING DEVICE

[76] Inventor: Horace H. Meday, 1322 Martino Rd., Lafayette, Calif. 94549

[21] Appl. No.: 38,645

[22] Filed: May 14, 1979

[51] Int. Cl.[3] ..... G06F 15/44; A63B 71/06

[52] U.S. Cl. ..... 364/411; 235/92 GA; 273/148 R; 340/323 R; 364/709

[58] Field of Search ..... 364/410, 411, 709, 710; 235/92 GA; 273/148 R, 237; 340/323 R

[56] References Cited

U.S. PATENT DOCUMENTS

| | | | |
|---|---|---|---|
| Re. 28,503 | 8/1975 | Townsend et al. | 235/92 GA X |
| 3,892,958 | 7/1975 | Tung | 364/709 |
| 3,909,626 | 9/1975 | Balasubramanian et al. | 364/710 |
| 4,051,605 | 10/1977 | Toal et al. | 364/410 X |
| 4,097,855 | 6/1978 | Salvo | 340/323 R |
| 4,130,871 | 12/1978 | Olsen et al. | 364/411 |

*Primary Examiner*—Jerry Smith

*Attorney, Agent, or Firm*—Julian Caplan; Willis E. Higgins

[57] ABSTRACT

This electronic scoring device allows scores for different players of a game to be kept and shown on separate displays. The device, preferably in hand-held form, has a plurality of score entry keys and a plurality of function keys. First and second display means of the device are assignable to opposing sides of a game. Circuit means is connected to the score entry keys, the function keys, and the display means to receive score information, carry out functions on the score information and display a resulting score on one of the displays for which the score information is entered. The device preferably operates under control of a suitable program incorporating scoring rules for a particular game being played. Game information is then entered by the keyboard, the resulting numerical score computed by the device, shown on the appropriate display, and entered into memory for the final game score.

8 Claims, 3 Drawing Figures

ELECTRONIC SCORING DEVICE

BACKGROUND OF THE INVENTION

1. Field of the Invention

This invention relates to a new type of electronic scoring device. More particular, it relates to such a device in which information of scoring significance is entered via a keyboard, a score is calculated, and the result shown on a display assigned to the player of a game to which score is awarded. Most especially, it relates to such a device which may be embodied in hand-held form.

2. Description of the Prior Art

Many games that have achieved a high degree of popularity have rather complex scoring rules. Examples of such games include bridge, tennis, gin rummy, darts and the like. Particularly in the case of bridge, it is common that beginning or less skilled players may not be able to keep score properly. This has meant that such players must include at least one person in the game who knows how to keep the score. In an effort to alleviate such problems, the use of certain mechanical scoring aids for certain games, such as darts and cribbage, is known.

More recently, various electronic games and educational devices have become known. For example, Simone, U.S. Pat. No. 4,126,949 discloses an educational calculator, which is used by one person. Toal et al, U.S. Pat. No. 4,051,605 discloses a competitive system in which the same problem is presented simultaneously to two educational calculators and score points awarded to the users. Video games are also representative of competitive electronic devices.

A variety of electronic teaching systems outside of the computation field are also known. Koizumi et al, U.S. Pat. No. 3,905,128 is representative of such devices.

It should be noted that a factor common to these electronic devices is that the device itself is used to play the game or carry out the learning experience in each case. Thus, while the art with respect to such electronic devices is now a well developed one, a need remains for an electronic device which can be used for scoring a game conveniently and easily which is played independently of the device.

SUMMARY OF THE INVENTION

Accordingly, it is an object of this invention to provide an electronic device in which scoring information for a game played independently of the device may be entered in a simplified manner, scoring operations carried out on the information, and a resulting score displayed for the user.

It is another object of the invention to provide a hand-held electronic scoring device for a game in which scoring information for opposing sides may be entered via a keyboard, the information processed, and the results for each side separately displayed.

It is a further object of the invention to provide a scoring device in which scoring information for opposing sides of a game may be entered in a simplified manner via a keyboard, processed to give a score for each side, and a resulting score shown on a display assigned to each side.

It is still another object of the invention to provide an electronic device which will allow players of a game who have not memorized scoring rules for the game to keep score by supplying abbreviated game information on events of scoring significance to the device, and thereby to generate the related game score.

The attainment of the foregoing and related objects may be achieved through use of the novel electronic scoring device herein disclosed. The scoring device of this invention includes a case with a plurality of score entry keys and function keys on the case. First and second display means having a distinguishing characteristic from each other are assignable to opposing sides of a game.

Circuit means is connected to the score entry keys, the function keys and the first and second display means. The circuit means receives score information, carries out functions thereon and displays a resulting score on the one of the displays for which the score information is entered.

In a preferred embodiment, the device is configured in self-contained form in the case, and each of the displays is in a different color to distinguish more readily between the scoring display for each player. In an especially preferred embodiment, the score keys are of the double entry type, in which an additional function key is provided to indicate which of the double entries is intended when one of the score keys is depressed. The electronic scoring device may either have scoring rules for a particular game built into its circuits, such as with a read only memory (ROM), or be programmable with the scoring rules for different games, such as through use of interchangeable read only memory modules.

The attainment of the foregoing and related objects, advantages and features of the invention will be more readily apparent after review of the following more detailed description of the invention, taken together with the drawings, in which:

DETAILED DESCRIPTION OF THE INVENTION

Figure 1:
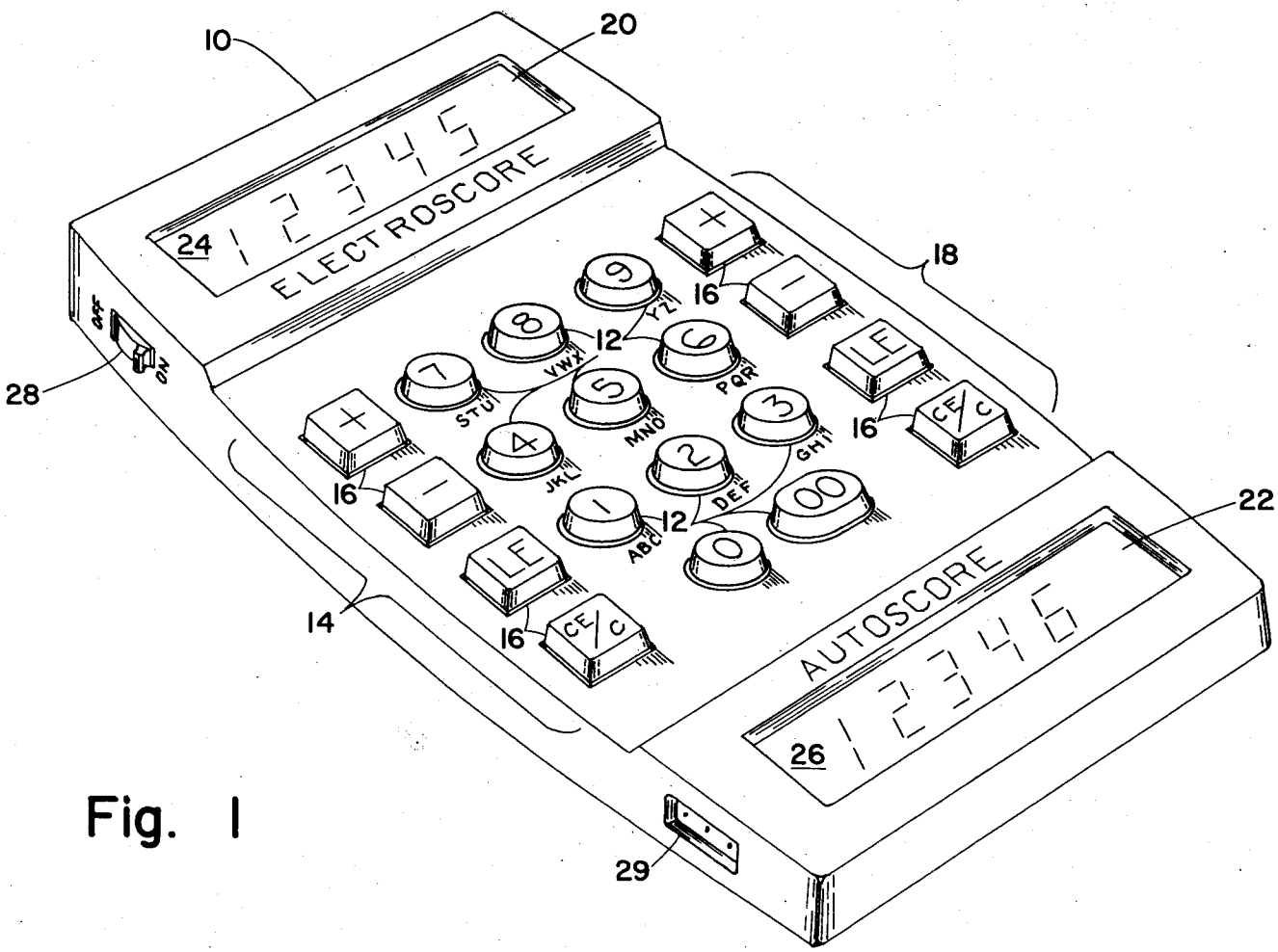
FIG. 1 is an external perspective view of a scoring device in accordance with the invention.

Turning now to the drawings, more particularly to FIG. 1, an external view of an electronic scoring device in accordance with the invention is shown. The device has a case 10 having a plurality of score entry keys 12, a first group 14 of function keys 16 and a second group 18 of function keys 16. The first group 14 of function keys 16 is associated with upper display 20. The second group 18 of function keys 16 is associated with the lower display 22. The letter designations under the numerical score entry keys 12 allow mnemonic expressions to be employed in simplified score entry codes, even though the device recognizes keystrokes by number. This is analogous to the letter designations on a telephone dial or Touch Tone key pad and is a convenience to the user arising from the fact that it is easier for humans to remember a multiple digit combination of letters and numbers than numbers alone.

The displays 20 and 22 are shown as five digits of conventional 7-segment numerical digits although a greater or lesser number of digits could be incorporated in each display. The displays may be implemented, for example, with either light emitting diodes or in liquid crystal form. The displays preferably have a distinguishing characteristic. Thus, if light emitting diodes (LEDs) are used for the displays, red LEDs may be employed for one display and green LEDs for the other display. If liquid crystal displays are employed, their backgrounds 24 and 26 may be of different colors. A conventional on/off switch 28 completes the keyboard of the device. The switch 28 is located on the side of the device to avoid accidental turn off and destruction of information during a game. It is preferred that stored score information for a game in process be cleared only by turning the device off for further protection against accidental loss of information. A receptacle 29 is provided on the case for a pluggable read only memory (ROM) module containing scoring programs for different games, thus allowing the device to be used for scoring games with a wide variety of different scoring rules.

Figure 2:
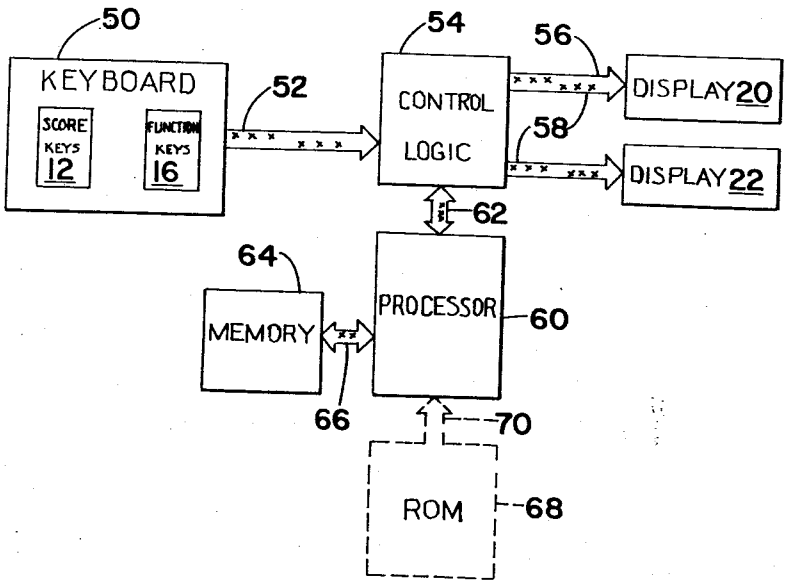
FIG. 2 is a block diagram of circuitry for the scoring device in FIG. 1.

FIG. 2 is a block diagram showing necessary circuit elements for operation of the scoring device shown in FIG. 1. The keyboard, indicated generally at 50, includes the score keys 12 and the function keys 16 as shown in FIG. 1. Cable 52 connects the keyboard 50 to control logic 54. Control logic 54 interfaces with display 20 and display 22 by means of cables 56 and 58. Control logic 54 also is connected to processor unit 60 by means of a bi-directional bus 62, to allow the flow of information in both directions between these units. Processor 60 carries out data processing operations on scoring information entered via keyboard 50. The control logic 54 includes at least sufficient registers for holding information to be shown on display 20 or 22 and various logic gates. Processor 60 includes similar registers for holding information to be operated on in a conventional manner. Processor 60 is connected to a random access memory 64 by means of a bi-directional memory bus 66, to allow information to be supplied to and withdrawn from the memory 64 in response to commands from the processor 60.

Control logic 54 typically includes a ROM which contains a control program for implementing the various functions of the system in a known manner. Processor 60 also includes a ROM in which scoring rules for a particular game are stored. Alternatively, if it is desired to make the scoring device programmable to allow its use for scoring different games, the scoring rules are stored in a separate ROM 68, connected to the processor 60 by means of cable 70. Such a ROM is typically implemented as a plug-in module which would fit into the receptacle 29 shown in FIG. 1.

In practice, a system in accordance with the block diagram of FIG. 2 can be implemented employing the commercially available MM5781 and MM5782 controller oriented processor systems integrated circuit, obtainable from National Semiconductor Corporation, Santa Clara, California 95051. When those integrated circuits are employed together with the commercially available DS8664 and DS8867 display interface circuits, also obtainable from National Semiconductor Corporation, the system can be implemented with those four integrated circuits, a keyboard matrix and two commercially available LED or liquid crystal displays. If desired, such a system may interface with a commercially available printer, such as a Seiko Model No. 310, using the commercially available MM5788 printer interface circuit, also obtainable from National Semiconductor. Further details on the use of these commercially available parts may be found in their respective data sheets.

In use of the scoring device as shown in FIGS. 1 and 2, score entries are made employing the score entry keys 12 to enter scores to be added or subtracted from the total for one of the players. The display 20 is assigned to one player, and the display 22 is assigned to the other player. The function keys 16 on the left-hand side of the keyboard in FIG. 1 control information displayed on upper display 20, and the function keys 16 on the right-hand side of the keyboard control information displayed on the lower display 22. The plus and minus keys respectively add or substract the number entered with the score keys from the total shown on the display controlled by the function key depressed. The "LE" keys recall the last entry made to the display which they control. The "CE/C" keys eliminate an erroneous entry for the display they control if depressed once, or clear the system of a called-up last entry for that display if depressed twice.

Figure 3:
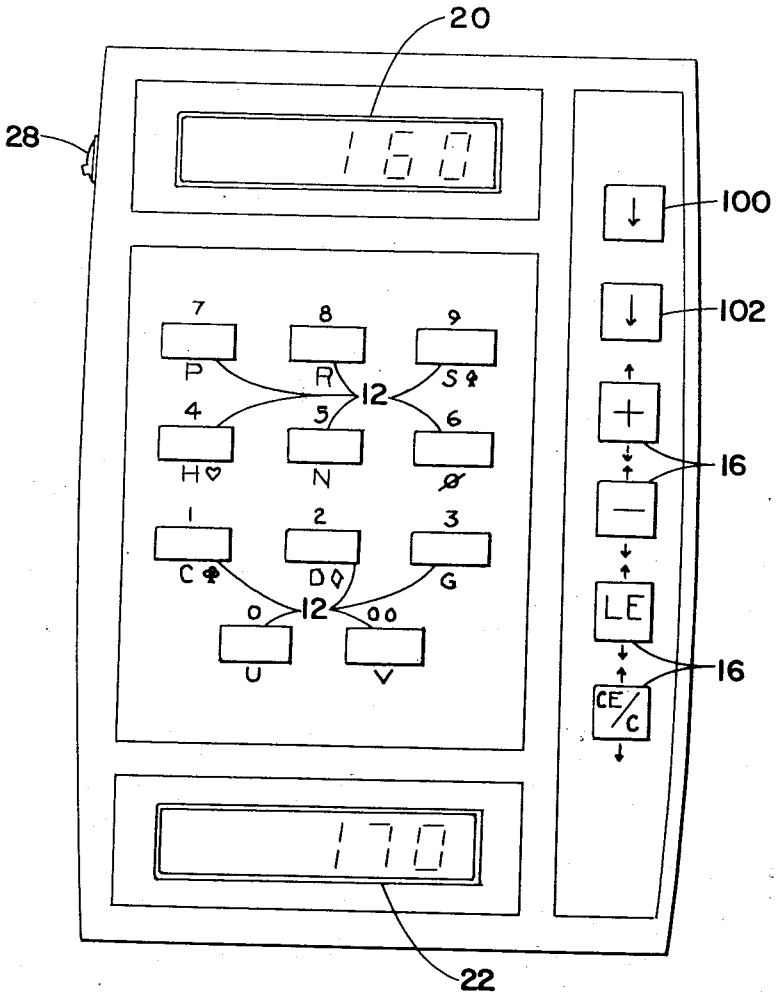
FIG. 3 is a plan view of a keyboard for another embodiment of the invention.

FIG. 3 shows another embodiment of a keyboard for a system in accordance with the invention. The keyboard shown is especially adapted for bridge scoring. As shown, the score entry keys 12 are double function, i.e., they enter either the number shown above each key or the letter shown below each key. If function key 100 is depressed, it causes the score keys to enter the letter shown; otherwise, the score keys enter the numbers. Function key 102 determines whether an entry is made for the upper display 20 or the lower display 22. If function key 102 is not depressed, the entry is made to the upper display 20. If function key 102 is depressed, the entry is made in the lower display 22. The remaining function keys 16 operate in the same manner as in the embodiment of FIG. 1, except that the functions in question are carried out for the upper display 20 or the lower display 22 with the same keys, depending on whether the function key 102 is depressed. Use of such alphanumeric score entry keys 12 allows events of scoring significance in bridge to be entered in a highly simplified, easily remembered manner so that the system can compute the resulting score from the event in question and show the result in the appropriate display. For example, if function key 102 is depressed, the 5 score entry key, function key 100 and the S-score key, this would show that a five spades contract was made by the side to which lower display 22 was assigned. Circuitry for the embodiment of FIG. 3 is also in accordance with the block diagram of FIG. 2, and the same commercially available integrated circuits listed above for implementing the embodiment of FIG. 1 could be used.

The application of an electronic scoring device having a keyboard as shown in FIG. 3 to contract bridge should be more readily apparent from the following example. Contract bridge scoring is based on successful contract bidding and resulting game and rubber completion. Various premium and bonus scores for penalties and awards are made. Special irregular values are assigned to various scoring elements associated with playing results, including contract tricks, overtricks, game and related vulnerability, face card honors, undertricks, double and redouble contracts, slam bids, and rubber. Successful contract bids are symbolized by the number of tricks and suit, as are overtricks. Unsuccessful bids are symbolized by number and undertricks, as amended by double, redouble, and vulnerable considerations.

In order to score contract bridge utilizing the device of this invention, the following scoring table is stored in a ROM or other suitable memory medium.

ELECTRONIC CODES AND SCORES APPLICABLE TO CONTRACT BRIDGE

| CONTRACT TRICKS | BASE SCORE CODE SCORE MINOR | | BASE SCORE CODE SCORE MAJOR | | BASE SCORE CODE SCORE NOTRUMP | | DOUBLED CODE SCORE MINOR | | DOUBLED CODE SCORE MAJOR | | DOUBLED CODE SCORE NOTRUMP | | REDOUBLED CODE SCORE MINOR | | REDOUBLED CODE SCORE MAJOR | | REDOUBLED CODE SCORE NOTRUMP | |
|---|---|---|---|---|---|---|---|---|---|---|---|---|---|---|---|---|---|---|
| 1 | 1C,1D | 20P | 1H,1S | 30P | 1N | 40P | 1CD,1DD | 40P | 1HD,1SD | 60P | 1ND | 80P | 1CR,1DR | 80P | 1HR,1SR | 120G | 1NR | 160G |
| 2 | 2C,2D | 40P | 2H,2S | 60P | 2N | 70P | 2CD,2DD | 80P | 2HD,2SD | 120G | 2ND | 140G | 2CR 2DR | 160G | 2HR 2SR | 240G | 2NR | 280G |
| 3 | 3C,3D | 60P | 3H,3S | 90P | 3N | 100G | 3CD,3DD | 120G | 3HD,3SD | 180G | 3ND | 200G | 3CR 3DR | 240G | 3HR 3SR | 360G | 3NR | 400G |
| 4 | 4C,4D | 80P | 4H,4S | 120G | 4N | 130G | 4CD,4DD | 160G | 4HD,4SD | 240G | 4ND | 260G | 4CR 4DR | 320G | 4HR 4SR | 480G | 4NR | 520G |
| 5 | 5C,5D | 100G | 5H,5S | 150G | 5N | 160G | 5CD,5DD | 200G | 5HD,5SD | 300G | 5ND | 320G | 5CR 5DR | 400G | 5HR 5SR | 600G | 5NR | 640G |
| 6 | 6C,6D | 120G | 6H,6S | 180G | 6N | 190G | 6CD,6DD | 240G | 6HD,6SD | 360G | 6ND | 380G | 6CR 6DR | 480G | 6HR 6SR | 720G | 6NR | 760G |
| 7 | 7C,7D | 140G | 7H,7S | 210G | 7N | 220G | 7CD,7DD | 280G | 7HD,7SD | 420G | 7ND | 440G | 7CR 7DR | 560G | 7HR 7SR | 840G | 7NR | 880G |

| OVER-TRICKS | MINOR | | MAJOR | | NOTRUMP | | (NOT VULNERABLE) ALL SUITS | | (VULNERABLE) ALL SUITS | | (NOT VULNERABLE) ALL SUITS | | (VUNERABLE) ALL SUITS | |
|---|---|---|---|---|---|---|---|---|---|---|---|---|---|---|
| 1 | 1Cϕ,1Dϕ | 20 | 1Hϕ1Sϕ | 30 | 1Nϕ | 30 | 1ϕD | 100 | 1ϕDV | 200 | 1ϕR | 200 | 1ϕRV | 400 |
| 2 | 2Cϕ,2Dϕ | 40 | 2Hϕ2Sϕ | 60 | 2Nϕ | 60 | 2ϕD | 200 | 2ϕDV | 400 | 2ϕR | 400 | 2ϕRV | 800 |
| 3 | 3Cϕ,3Dϕ | 60 | 3Hϕ3Sϕ | 90 | 3Nϕ | 90 | 3ϕD | 300 | 3ϕDV | 600 | 3ϕR | 600 | 3ϕRV | 1200 |
| 4 | 4Cϕ,4Dϕ | 80 | 4Hϕ4Sϕ | 120 | 4Nϕ | 120 | 4ϕD | 400 | 4ϕDV | 800 | 4ϕR | 800 | 4ϕRV | 1600 |
| 5 | 5Cϕ,5Dϕ | 100 | 5Hϕ5Sϕ | 150 | 5Nϕ | 150 | 5ϕD | 500 | 5ϕDV | 1000 | 5ϕR | 1000 | 5ϕRV | 2000 |
| 6 | 6Cϕ,6Dϕ | 120 | 6Hϕ6Sϕ | 180 | 6Nϕ | 180 | 6ϕD | 600 | 6ϕDV | 1200 | 6ϕR | 1200 | 6ϕRV | 2400 |

| UNDER-TRICKS | (NOT VULNERABLE) ALL SUITS | | (VULNERABLE) ALL SUITS | | (NOT VULNERABLE) ALL SUITS | | (VULNERABLE) ALL SUITS | | (NOT VULNERABLE) ALL SUITS | | (VUNERABLE) ALL SUITS | |
|---|---|---|---|---|---|---|---|---|---|---|---|---|
| 1 | 1U | 50 | 1UV | 100 | 1UD | 100 | 1UDV | 200 | 1UR | 200 | 1URV | 400 |
| 2 | 2U | 100 | 2UV | 200 | 2UD | 300 | 2UDV | 500 | 2UR | 600 | 2URV | 1000 |
| 3 | 3U | 150 | 3UV | 300 | 3UD | 500 | 3UDV | 800 | 3UR | 1000 | 3URV | 1600 |
| 4 | 4U | 200 | 4UV | 400 | 4UD | 700 | 4UDV | 1100 | 4UR | 1400 | 4URV | 2200 |
| 5 | 5U | 250 | 5UV | 500 | 5UD | 900 | 5UDV | 1400 | 5UR | 1800 | 5URV | 2800 |
| 6 | 6U | 300 | 6UV | 600 | 6UD | 1100 | 6UDV | 1700 | 6UR | 2200 | 6URV | 3400 |
| 7 | 7U | 350 | 7UV | 700 | 7UD | 1300 | 7UDV | 2000 | 7UR | 2600 | 7URV | 4000 |
| 8 | 8U | 400 | 8UV | 800 | 8UD | 1500 | 8UDV | 2300 | 8UR | 3000 | 8URV | 4600 |
| 9 | 9U | 450 | 9UV | 900 | 9UD | 1700 | 9UDV | 2600 | 9UR | 3400 | 9URV | 5200 |
| 10 | 10U | 500 | 10UV | 1000 | 10UD | 1900 | 10UDV | 2900 | 10UR | 3800 | 10URV | 5800 |
| 11 | 11U | 550 | 11UV | 1100 | 11UD | 2100 | 11UDV | 3200 | 11UR | 4200 | 11URV | 6400 |
| 12 | 12U | 600 | 12UV | 1200 | 12UD | 2300 | 12UDV | 3500 | 12UR | 4600 | 12URV | 7000 |
| 13 | 13U | 650 | 13UV | 1300 | 13UD | 2500 | 13UDV | 3800 | 13UR | 5000 | 13URV | 7600 |

OTHER SCORES

| | | | | | | | | | | | | | | | | | | |
|---|---|---|---|---|---|---|---|---|---|---|---|---|---|---|---|---|---|---|
| SMALL SLAM | SS | 500S | SSV | 750S | DOUBLE(RE-) | | D | 50C | R | 50C | RUBBER-2GAME | 2G | 700R | RUBBER-1GAME | | 1G | 300R | |
| GRAND SLAM | GS | 1000S | GSV | 1500S | CONTRACT MADE | | | | | | RUBBER-3GAME | 3G | 500R | RUBBER-PART GAME | | PG | 50R | |
| HONORS (Any one Hand) | 4 of 5 Top | | | | 100H | 100H | 5 Top(10.J.Q.K.A) | | 150H | 150H | 4 Aces | 150H | 150H | | | | | |

As used in the table, the letter designations have the following meanings: C=clubs, D=diamonds if used immediately after a number, or double if used after a letter, G=game, H=hearts, O=overtrick, P=part game, R=rubber if used immediately after a number, or redouble if used after another letter, S=spades, U=undertrick, V=vulnerable, GS=grand slam, PG=part game, SS=small slam. As noted in the table, combinations of these symbols designations may also be employed. For example, GSV represents grand slam, vulnerable. Use of the symbols as shown in Table I results in the corresponding score entries for either we or they, depending on which is indicated through use of the function key 102.

Table II shows the keyboard entries and resulting scores displayed for an actual bridge game.

TABLE II

SAMPLE BRIDGE GAME ILLUSTRATING ELECTRONIC CODING AND SCORING

| | SCORE PAD | | | | | | | |
|---|---|---|---|---|---|---|---|---|
| | WE | THEY | HAND RESULT | CODE | W T | W DISPLAY | T DISPLAY | |
| | 500 | | Bid 3 Diamonds, made 7 | H1 | + | H1 | | |
| (6) | 30 | | | 3D | + | 60P | | |
| (1) | 80 | 40 (5) | | 4Dϕ | + | 80 | | |
| (1) | 60 | 80 (2) | 2 Bid, made 4 Clubs | H2 | + | | H2 | |
| | | 180 (3) | | 4C | + | | | 80P |
| (4) | 100 | | 3 Bid 3 Hearts, made 6 | H3 | + | | H3 | |
| (6) | 60 | 60 (5) | | 3H | + | | | 90P |
| (7) | 90 | | | 3Hϕ | + | | 90 | |
| | 920 | 360 | 4 Bid, made 3 No Trump | H4 | + | H4 | | |
| | | | | 3N | + | 100G | | |
| | | | Check Score - Game | GG | ++ | 160 | | 170 |
| | | | Check Score - Bonus (Premium) | PP | ++ | 80 | 90 | |
| | | | 5 Bid 3 Clubs, made 5 | H5 | + | | H5 | |
| | | | | 3C | + | | | 60P |
| | | | | 2Cϕ | + | | 40 | |
| | | | 6 Bid 2 Space, made 3 | H6 | + | H6 | | |
| | | | | 2S | + | 60P | | |
| | | | | 1Sϕ | + | 30 | | |
| | | | 7 Bid, made 3 Hearts | H7 | + | H7 | | |
| | | | | 3H | + | 90P | | |
| | | | Total Games - Game 1 | GG1 | ++ | 60P | | 170G |
| | | | Game 2 | GG2 | ++ | 100G | | |
| | | | Game 3 | GG3 | ++ | 150G | | 60P |
| | | | Award Rubber Bonus | 3G | + | 500R | | |
| | | | Total Bonus - | PP | ++ | 610 | 130 | |
| | | | Total Rubber - | RR | ++ | 920 | | 360 |

For comparative purposes, the first two columns show the conventional hand-scoring for the game. Column 3 shows the hands. Column 4 shows the result for each hand, column 5 shows the score key entries for the hands, column 6 shows the function key entries. Columns 7 and 8 show the resulting score information on the displays. If a printer is utilized, the tape will have a print-out corresponding to columns 7 and 8. This approach would be employed for tournment or serious bridge. It should be noted that part game and game scores and their subtotals are right-hand justified in the display format and bonus scores and their subtotals are left-hand justified.

As indicated, the various subtotals and totals are obtained by successive entries of only the plus function key in sequence. These successive entries produce first a subtotal of game points, a subtotal for bonus points, next a second game total, then a total of rubber points. A new plus function key sequence after the rubber points gives a cumulative game point total, then a cumulative bonus point total, and finally a grand total. If desired, a subtotal/total function key can be provided, rather than using the plus function key for this purpose.

It should now be apparent to those skilled in the art that an electronic device capable of achieving the stated objects of the invention has been provided. Scoring events for a game may be entered via the keyboard of the device in a simplified manner, the resulting score computed by the device, and displayed separately for each player or side of the game. This means that scores for games with even very complex scoring rules, such as bridge, may be kept rapidly and conveniently without memorizing the scoring rules.

It should further be apparent to those skilled in the art that various changes in form and details of the invention may be made. It is intended that such changes be included within the spirit and scope of the claims appended hereto.

What is claimed is:

1. A hand-held electronic scoring device, which comprises:

(a) a case, (b) A plurality of double entry score keys on said case, each representing a particular number and an alphabetical letter of a mnemonic code for entry of information of scoring significance in a game being played independent of said device, at least some of the letters representing more than one event of scoring significance, with selection from the more than one event being determined by keystroke sequence for an entry, (c) a plurality of function keys on said case with at least one of said function keys for choosing between entry of the particular number and the letter for a keystroke of one of the double entry score keys and at least one function key for assigning the entry to one of said first and second displays, (d) first and second display means in said case having a distinguishing characteristic from each other and being assignable to opposing sides of a game, and (e) circuit means connected to said double entry score keys, function keys and first and second display means to receive score information, carry out functions thereon and display a resulting score on the one of said displays for which the score information is entered.

2. The scoring device of claim 1 in which said circuit means is programmable in accordance with scoring rules for a particular game being played.

3. The scoring device of claim 1 in which a score is assignable to either said first display or said second display by means of at least one entry function key.

4. An electronic scoring device, which comprises:

a keyboard including a plurality of double entry score keys, each representing a particular number and an alphabetical letter of a mnemonic code for entry of information of scoring significance in a game being played independently of said device, at least some of the letters representing more than one event of scoring significance, with selection from the more than one event being determined by keystroke sequence for an entry, and a plurality of function keys, including at least one function key for assigning an entry to a player of a game being scored and at least one function key for choosing between the number and the letter for a keystroke of each double entry score key, at least a first and second display means assignable to opposing sides of the game, logic circuit means connecting said keyboard to said first and second display means, a processor connected to said logic circuit means for carrying out operations on scoring data entered via said keyboard under control of a program incorporating scoring rules for a particular game being played, the results of at least some of said operations being selectively displayed on one of said first and second displays depending on which of the players to which the results are to be attributed, and a memory connected to said processor for storing score information during the playing of the game.

5. The scoring device of claim 4 further comprising a recall function key and circuit means connected to the function key for recalling stored scoring information to said first and second display means.

6. An electronic bridge scoring device which comprises:

a keyboard including a plurality of double entry score keys, each representing a particular number and an alphabetical letter of a mnemonic code for entry of information of scoring significance in a game being played independently of said device, at least some of the letters representing more than one event of scoring significance, with selection from the more than one event being determined by keystroke sequence for an entry and a plurality of function keys including at least one key for assigning an entry to one of the sides of a bridge game and at least one key for choosing which of the double entries of a score keystroke is intended, first and second display means assignable to opposing sides of the bridge game, memory means containing a stored program for converting hand result information entered via said keyboard to a score determined by scoring rules for bridge, a processor operable under control of the stored program for converting the hand result information to the score, and logic circuit means interconnecting said keyboard, processor and displays.

7. The electronic bridge scoring device of claim 6 in which said displays comprise a printer having a plurality of line positions dividable into two groups, each assignable to one of the opposing sides.

8. The electronic bridge scoring device of claim 7 in which said displays are light emitting diode or liquid crystal displays.

* * * * *